United States Patent [19]

Nankivell

[11] Patent Number: 4,516,774

[45] Date of Patent: May 14, 1985

[54] HAND PADDLE FOR A PADDLE BALL GAME

[76] Inventor: David L. Nankivell, 5792 Carell Ave., Agoura Hills, Calif. 91301

[21] Appl. No.: 499,937

[22] Filed: Jun. 1, 1983

[51] Int. Cl.[3] ..... A63B 59/00

[52] U.S. Cl. ..... 273/67 B

[58] Field of Search ..... 273/67 R, 67 B, 76, 273/DIG. 30; D21/210–213; 441/56–58; 2/16, 19, 20; 272/71

[56] References Cited

U.S. PATENT DOCUMENTS

| | | | |
|---|---|---|---|
| 703,519 | 7/1902 | Becker | 273/76 |
| 819,250 | 5/1906 | Paget | 273/67 B |
| 950,633 | 3/1910 | Eastman | 2/20 X |
| 1,051,169 | 1/1913 | Snell | 441/58 |
| 1,477,460 | 12/1923 | Smith | 273/67 B |
| 2,159,972 | 5/1939 | Larson | 441/58 |
| 2,726,410 | 12/1955 | Adamopoulos | 441/57 |
| 3,231,910 | 2/1966 | Tegland | 441/57 |

FOREIGN PATENT DOCUMENTS

| | | | |
|---|---|---|---|
| 2641625 | 3/1978 | Fed. Rep. of Germany | 273/67 B |
| 7605224 | 9/1977 | Netherlands | 273/67 B |

*Primary Examiner*—Richard C. Pinkham
*Assistant Examiner*—Matthew L. Schneider

[57] ABSTRACT

A hand paddle for a paddle ball game includes a back member with a back surface which is conformed generally to the shape of either a user's right or left hand. The paddle includes a contoured palm support region, a plurality of elongated finger receiving depressions extending from the palm support region and a thumb manipulation region adjacent to the palm support region and the elongated finger receiving depressions. Each elongated depression has a finger gripping ridge transverse thereto at a distal location relative to the palm support region for being gripped by the end of the finger positioned in that elongated depression. The back surface also includes a thumb gripping ridge adjacent the thumb manipulation region for being pressed against by the user's thumb to facilitate gripping of the back surface of the back member. Retention straps, including finger straps, crisscrossed hand straps and a crisscrossed wrist strap are attached to the back member for holding the hand paddle on the user's hand. The hand paddle further includes a ball contacting front member affixed to the back member to provide a surface for hitting the ball.

26 Claims, 10 Drawing Figures

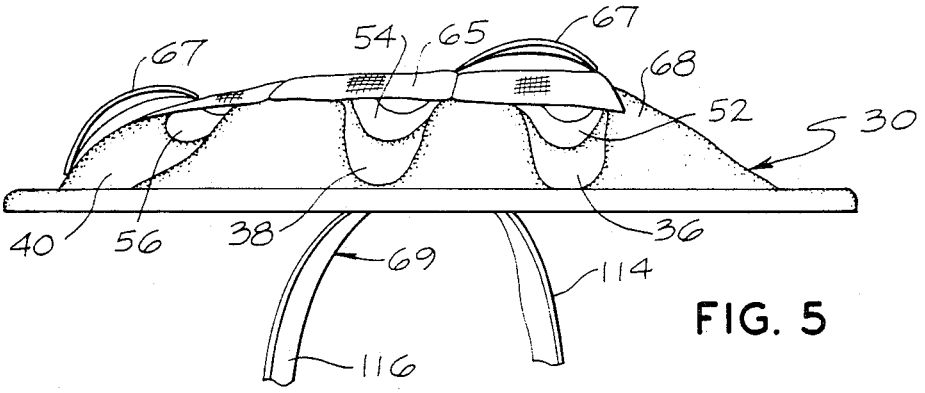
FIG. 5
FIG. 6A
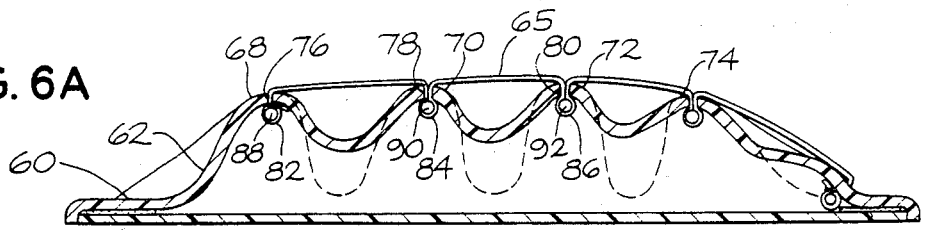
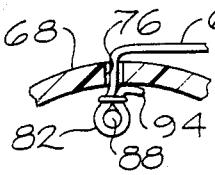
FIG. 6B
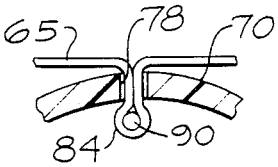
FIG. 6C
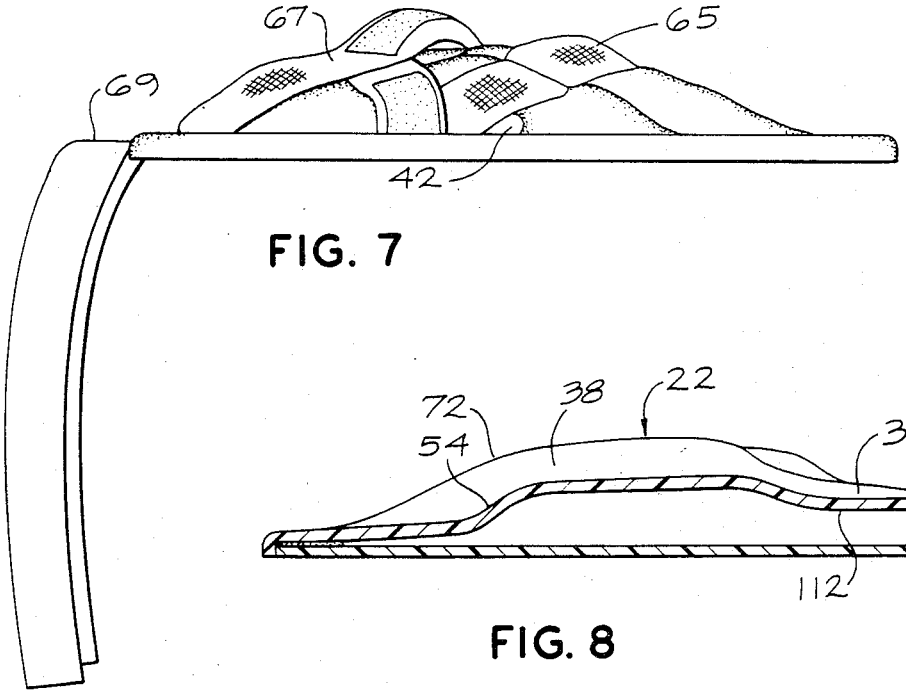
FIG. 7
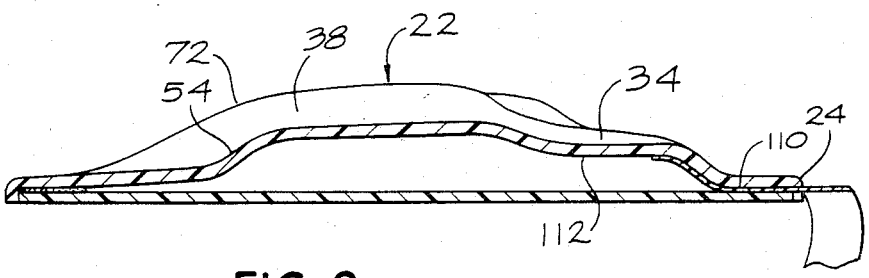
FIG. 8

HAND PADDLE FOR A PADDLE BALL GAME

BACKGROUND OF THE INVENTION

This invention relates to sports equipment and in particular to a hand paddle which is strapped onto a user's hand.

The sports of racketball and handball have gained increasing popularity in recent years. Such games are generally played in a four wall indoor or a three wall outdoor court. However, both handball and racketball have disadvantages. For example, in handball the player's hand can be injured due to hitting the ball. In addition, handball is somewhat difficult because the user's hands provide a small uneven surface area to hit the ball.

Racketball is played with a racket and therefore eliminates certain of the disadvantages of handball. However, racketball is not an ambidextrous sport. Therefore, the user risks overdevelopment of one arm and underdevelopment of the other. In addition, racketball has resulted in a high incidence of injury caused when a player is hit by the racket swinging at high velocity.

Unlike either the hand in handball or the racket in racketball, the present invention comprises a hand paddle which may be configured as either a left handed paddle to be worn on the left hand of the user or a right handed paddle to be worn on the right hand of the user. The present invention thus allows for an ambidextrous sport. Also, because the paddles are attached to the user's hand, there will be a significantly reduced incidence of injury to the user's hands or to the user's opponent due to being hit by a swinging racket. Finally, the hand paddles in accordance with the invention provide a flat surface against which the ball impacts rather than the uneven surface area of the hand as in handball.

Various types of hand paddles or bats have been developed for different types of games. Illustrative of those rackets are those disclosed in Smoak, U.S. Pat. No. 3,229,979; Rittenhouse, U.S. Pat. No. 1,523,900; Rittenhouse, U.S. Pat. No. 1,523,899; Brewer, et al, U.S. Pat. No. 1,558,666; Abrahams, et al, U.S. Pat. No. 492,343; Smith, U.S. Pat. No. 1,477,460; Rijan, U.S. Pat. No. 1,402,799; and Paget, U.S. Pat. No. 819,250.

Although each of these patents discloses a hand paddle or racket wherein the paddle is attached to the hand of the user by a suitable strap or glove mechanism, none of the references disclose a contoured hand conformed back surface or provide a means for gripping as part of the hand conformed back surface. In addition, the present invention includes a novel strap means which inclues finger straps, crisscrossed hand straps and a crisscross wrist strap mechanism for holding the racket firmly against the user's hand. The present invention also provides free movement of the user's thumb in a thumb manipulation region and a thumb gripping ridge against which the thumb can be pressed to grip the racket or against which a ball may be held by the thumb in preparation for service.

SUMMARY OF THE INVENTION

A paddleball game hand paddle for being worn on the fingered hand of a user includes a back member having a lower edge positioned for being adjacent to the wrist of the user and a hand conformed back surface. The hand conformed back surface inclues a contoured palm support region, a plurality of elongated depressions extending from the palm support region and a thumb manipulation region adjacent both the palm support region and the elongated depressions for receiving the thumb of the user and allowing sideward and upward manipulation of the user's thumb. The elongated depressions are configured and sized to receive a selected one of the user's fingers. Each elongated depression has a transverse finger gripping ridge at a distal location relative to the palm support region. The gripping ridges are positioned so that the ends of the finger in the depression can press against the ridge to enable gripping of the back surface of the paddle. The paddle further comprises a ball contacting front member which is affixed to the back member and retention strap means which are attached to the back member for holding the hand paddle on the user's hand.

In accordance with the invention, the retention strap means includes a finger strap attached to the back surface of the back member and extending across at least one of the elongated depressions for retaining the user's finger in the elongated depression. The strap means further includes a hand strap means attached to the hand conformed back surface of the back member which extend in a crisscross fashion across the contoured palm support region for retaining the user's palm adjacent to the palm support region. Finally, the strap means includes a wrist strap means affixed to the back member for being wrapped around the user's wrist and attached by suitable attachment means to the back member.

In accordance with the invention, the wrist strap preferably includes a 'Y' shaped strap which defines a leg strip and two arm strips. Each arm strap has end region. The leg strip is affixed to the front surface of the back member and extends out from the lower edge for being adjacent to the palm side of the user's wrist. The attachment means preferably includes a hook and loop attachment strip for removably coupling the end regions of the two arm strips to the back member. Finally, the hand paddle includes a thumb gripping ridge between the thumb manipulation region and one of the elongated depressions to facilitate gripping of the back member by the user's thumb and further to facilitate holding of a ball between the user's thumb and the thumb gripping ridge. The thumb gripping ridge generally extends in the same direction as the elongated depressions and generally transverse to the finger gripping ridges.

In one embodiment a ball receiving depression may be molded or otherwise provided in the thumb manipulation region to facilitate holding a ball with the user's thumb.

BRIEF DESCRIPTION OF THE DRAWINGS

A complete understanding of the present invention and of the above and other advantages thereof may be gained from a consideration of the following description of the preferred embodiments taken in conjunction with the accompanying drawings in which:

FIG. 5 is a front end view of the hand paddle in accordance with the invention.

FIG. 6*a* is a cross sectional view through section 6—6 in FIG. 2.

FIG. 6*b* is a partial cross sectional view of one mechanism for attaching an end of the finger retention strap to the back member in accordance with the invention.

FIG. 6*c* is a partial cross sectional view illustrating one mechanism for attaching a central region of the finger strap to the back member.

FIG. 7 is a side view of the hand paddle in accordance with the invention.

FIG. 8 is a sectional side view of the hand paddle in accordance with the invention.

DETAILED DESCRIPTION

Figure 1:
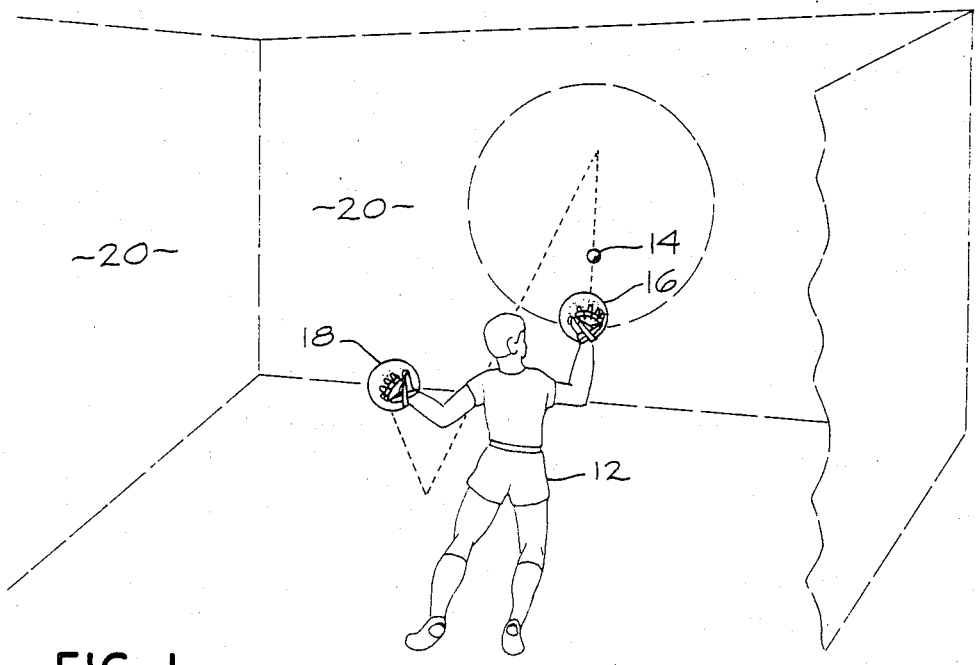
FIG. 1 is a pictorial view of a user in a game court with a right hand paddle in accordance with the invention on the user's right hand and a left hand paddle on the user's left hand.
Figure 2:
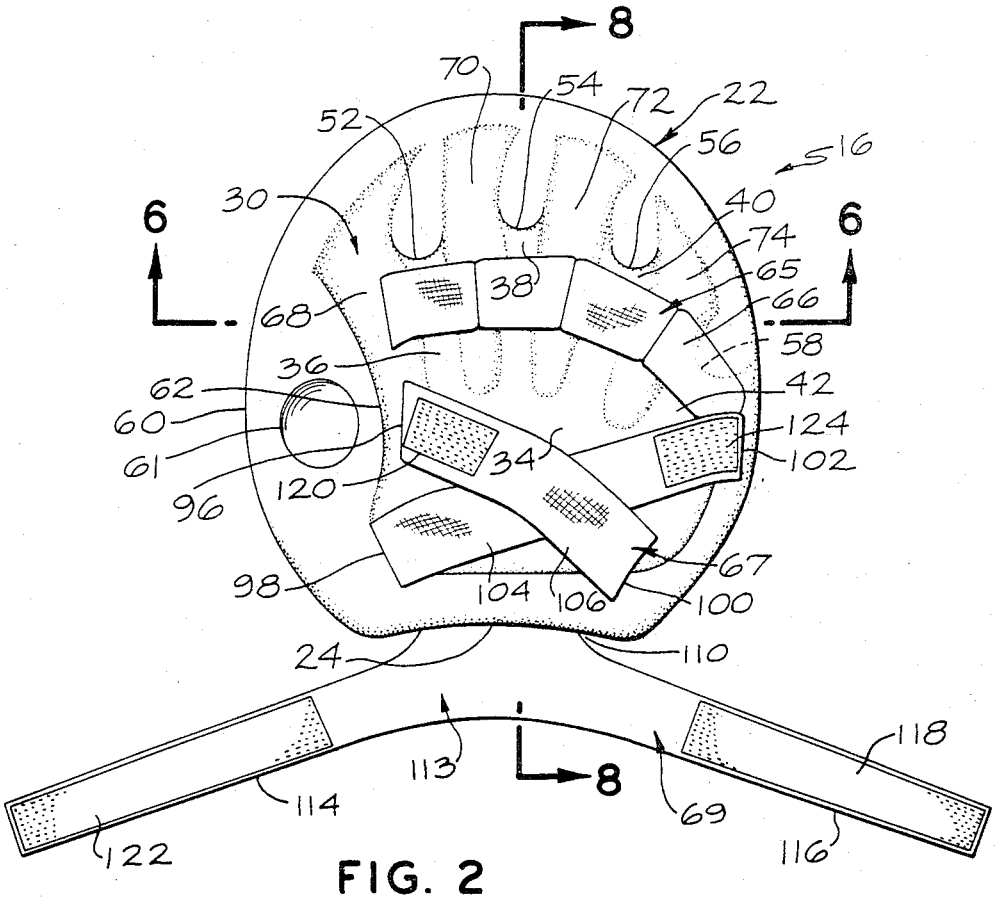
FIG. 2 is a top view of a hand paddle in accordance with the invention.

Referring initially to FIG. 1 in conjunction with FIG. 2, the present invention comprises a hand paddle which may be configured as either a right hand paddle 16 or a left hand paddle 18. Such a hand paddle 16 or 18 may be used in any of a number of different ways to bat a ball. However, in the preferred embodiment, a user 12 simultaneously wears the right hand paddle 16 and the left hand paddle 18 and hits a ball 14 in either a three wall or four wall game court 20 following substantially the rules of either racketball or handball.

Referring more particularly to FIGS. 2, 3, 4 and 7, the right hand paddle 16 includes a back member 22 which has a generally oval periphery with a concave indentation in its oval periphery defining a lower edge 24 which will be adjacent to the inside or palm side 26 of a user's wrist 28. The back member 22 is preferably made out of molded plastic to define a hand conformed back surface 30. The hand conformed back surface 30 is preferably roughened or otherwise textured to facilitate gripping of the hand conformed back surface 30 by the hand 32 of the user 12.

Referring additionally to FIGS. 5 and 8, the hand conformed back surface 30 includes a raised and contoured palm support region 34 with a plurality of elongated depressions 36, 38, 40 and 42 extending radially out from the palm support region 34. Each of the elongated depressions 36, 38, 40 and 42 are configured and sized to receive one of the user's fingers. Thus, the first elongated depression 36 is configured and sized to receive the index finger 44 of the user; the second elongated depression 38 is configured and sized to receive the middle finger 46 of the user; the third elongated depression 40 is configured and sized to receive the third finger 48 of the user; and the fourth elongated depression 42 is configured and sized to receive the user's little finger 50.

Each elongated depression 36, 38, 40 and 42 includes a finger gripping ridge 52, 54, 56 and 58 respectively. The finger gripping ridges 52, 54, 56 and 58 are located at the distal region of the respective elongated depressions and provide a generally vertical surface against which the user 12 can press the tips of his or her fingers to effect gripping of the back surface 30 of the hand paddle 16.

Figure 3:
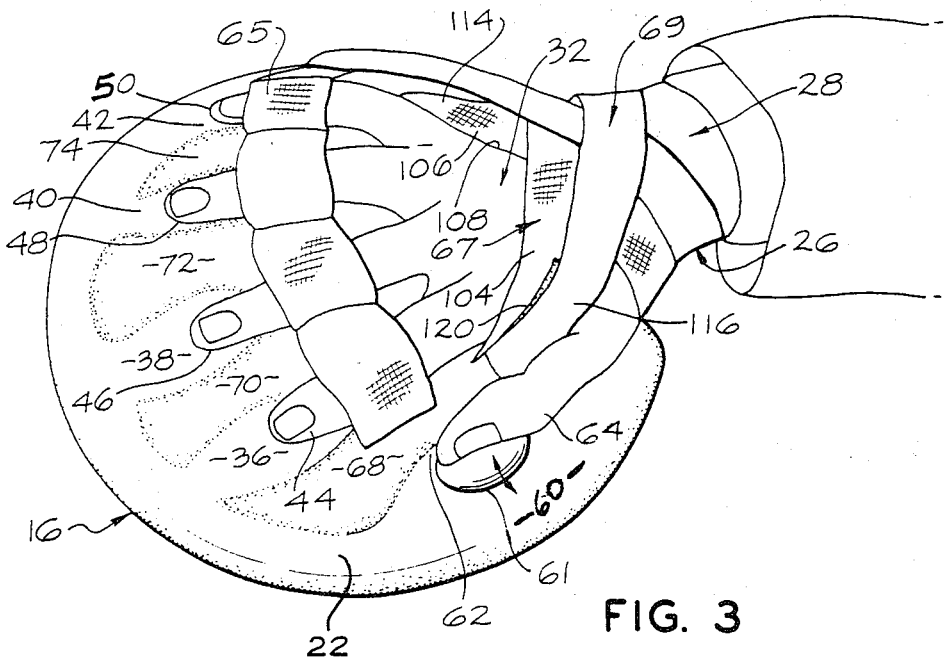
FIG. 3 is a pictorial view of a hand paddle in accordance with the invention in position on a user's hand.

Referring additionally to FIG. 6A, the hand conformed back surface 30 of the hand paddle 16 further includes a thumb manipulation region 60 which is essentially a flat region extending along the left side of the right hand paddle 16 or along the right side of a left hand paddle 18. The thumb manipulation region may have a ball receiving depression 61 molded or otherwise provided to extend into a central part of the thumb manipulation region 60. The depression 61 is preferably spherical in shape and of a size which conforms generally to the countour of the ball. The ball can then be positioned in the depression 61 and thereafter held in place by simply placing the user's thumb over the ball so that the ball is held in the depression 61. Of course, the depression could be oblong and of any convenient depth without departing from the invention. Additionally, there could be an upwardly rising around the depression as well. The thumb manipulation region 60 terminates in a thumb gripping surface 62 which extends upwardly from the major plane of the hand paddle 16 along one side of the ridge 68 and lengthwise along both the palm support region 34 and the elongated depression 36. The thumb gripping surface 62 thus extends radially outwardly in a direction generally parallel to the elongated depressions 36, 38, 40 and 42 and generally transverse to the finger gripping ridges 52, 54, 56 and 58 respectively. The thumb manipulation region 60 permits the user 12 to manipulate his thumb 64 in a side-to-side fashion across the thumb manipulation region 60 or to press against the thumb gripping surface 62 as illustrated in FIG. 3 to affect grasping of the hand paddle 16. Thus, when the user desires to grip onto the back surface 30 of the back member 22, the user simultaneously presses the ends of each of his or her fingers against the finger gripping ridges 52, 54, 56 and 58 and thumb against the thumb gripping surface 62.

The fact that the thumb is freely moveable laterally across the thumb manipulation region 60 and vertically away from the back surface 30 of the paddle enables the user 12 to put a second paddle on one hand after the first paddle is already on the user's other hand. In addition, the free movement of the thumb across the thumb manipulation region permits the user to pick up the ball and drop it to effect service. Using one method, the user can pick up the ball by applying "reverse english" in much the same way that a tennis ball can be picked up with a tennis racket. Alternatively, the user can pick up a ball by simply turning his hand over with the paddle attached and grasping the ball by clamping it between the user's thumb and either the thumb manipulation region 60 or the thumb gripping surface 62. Thus, the thumb gripping surface 62 provides a molded depression between the thumb and the forefinger which aids the user in holding the ball against the thumb gripping surface 62.

Referring to FIGS. 2, 5 6A and 7 the hand paddle 16 further includes hand strap means for holding the paddle 16 on the user's hand during paddleball game play. In the preferred embodiment, the retension strap means includes a finger strap means 65, a hand strap means 67 and wrist strap means 69. Referring to FIGS. 2, 3, 6A, 6B and 6C, the finger strap means 65 preferably comprises an elastic strap which is mounted to the ridge 68 between the thumb manipulation region 60 and the elongated depression 36; to the ridge 70 between the first elongated depression 36 and the second elongated depression 38; to the ridge 72 between the second elongated depression 38 and the third elongated depression 40; to the ridge 74 between the third elongated depression 40 and the fourth elongated depression 42; and to the side of the back member 22 adjacent the fourth elongated depression 42. Thus, as shown in FIG. 3, when the hand paddle 16 is placed on the user's hand 32, the user's fingers will extend along and be retained in the elongated depressions 36, 38, 40, and 42 by the elastic finger strap 65 which extends over each of the user's fingers 44, 46, 48 and 50 respectively.

Referring to FIGS. 6A, 6B and 6C, in the preferred embodiment, the elastic finger straps 65 are formed with a single elastic strip with one region of the elastic strip being pressed through a slot such as the slots 76, 78 and 80 through the apex of the ridges 68, 70 and 72 respectively. The portion of the elastic strip extending through each slot then forms a loop 82, 84 and 86 respectively through which a metal rod such as the metal rod 88, 90 and 92 respectively are inserted. The diameter of the metal rod is larger than the width of the slot thereby preventing the portion of the elastic finger strap extending through the slot from being pulled back through the slot when the hand paddle is placed on the hand or during game play.

In order to form the loop at the end of the elastic strip which extends through the slot 76 as illustrated in FIGS. 6A and 6B, a suitable clip, staple or other means may be used to clip the end of the elastic strip 94 to itself to thereby form the loop 82 in which the rod 88 is placed.

Referring to FIGS. 2 and 3, the hand strap means 67 is made of a similar elastic strap material used for the finger strap means 65 and is attached to the back surface 30 of the hand paddle 16 by passing the elastic strip through slots 96, 98, 100, and 102 extending through the back member 22 of the hand panel 16. The straps are then connected to the underside of the back member 22 using the loop/rod arrangement illustrated in FIGS. 6A, 6B and 6C with the slots 96, 98, 100 and 102 positioned so that the hand strap means will comprise a pair of elastic hand straps 104 and 106 which crosscross each other over the palm support region 34. Thus, when the hand is inserted into the paddle the straps 104 and 106 will crisscross over the back of the user's hand and hold the palm 108 of the user's hand 32 against the palm support region 34 of the back member 22.

Figure 4:
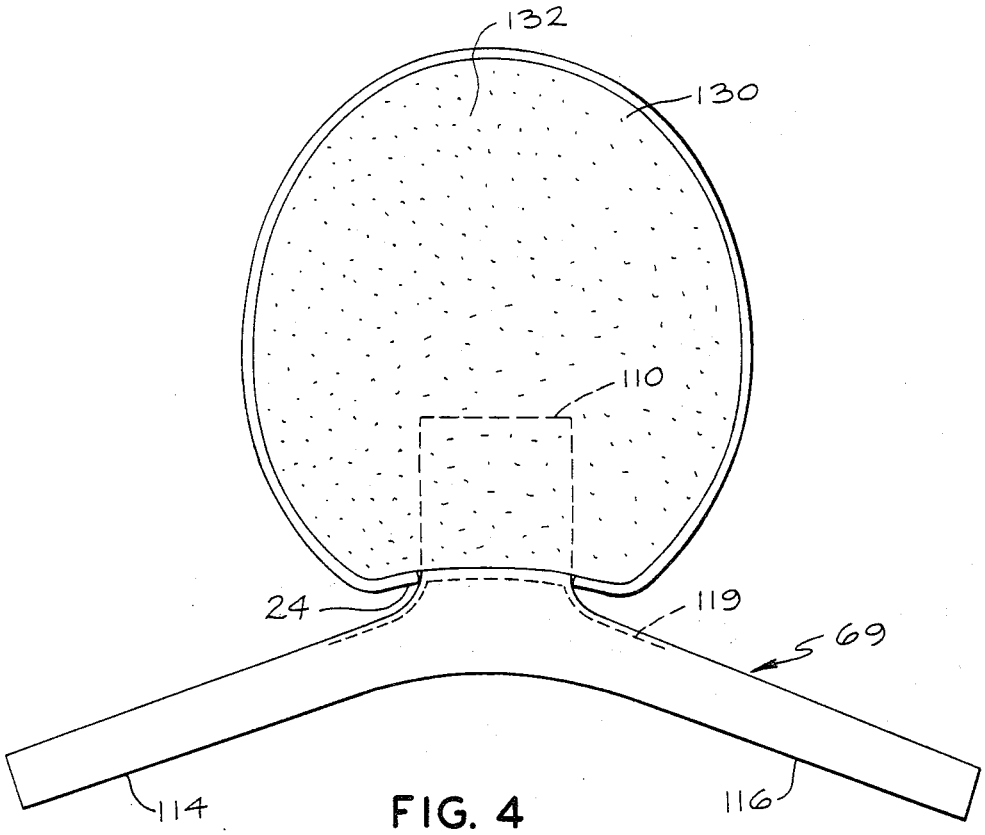
FIG. 4 is a front view of the hand paddle in accordance with the invention.

Referring next to FIGS. 2, 4 and 8, the strap means finally includes the wrist strap means 69 which comprises a Y-shaped member having a leg strip 110 which is adhesively or otherwise affixed to the front or inside surface 112 of the back member 22 opposite the back surface 30. The leg strip 110 then extends out from the lower edge 24 and branches outwardly to form a pair of arm strips 114 and 116 respectively. Suitable reinforcing stitching 118 may optionally be provided at the junction between the pair of arm strips 114 and 116 and the leg strip 110.

On the back or wrist facing side 113 of the arm strip 116 is attached by sewing or other suitable means a first adherent strip which may be a looped strip 118. A complementary third adherent strip such as a hooked strip 120 is then sewn on the back of hand strap 106 or otherwise suitably attached to the back member 22 for receiving and attaching to the first adherent strip 118. Similarly, the wrist strap arm 114 has a second adherent strip 122 sewn or otherwise affixed to its surface and a complentary fourth adherent strip 124 which is sewn or otherwise attached to the hand strap 104 or otherwise attached to the back member 22 to receive and hold the second adherent strip 122. The adherent strips 122 and 124 may for example be Velcro strips.

As illustrated in FIG. 3, the wrist strap arm 116 is wrapped around the side of the wrist and across the back of the hand and is attached to the adherent strip 120 while the wrist strap arm 114 is wrapped around the opposite side of the user's wrist crossing over the back of the user's hand 32 to be attached to the fourth adherent strip 24.

Referring to FIG. 4, the invention further comprises a ball contacting front member 130 which preferably has a roughened front surface 132 with a texture which will facilitate application of spin to the ball upon hitting the ball with the roughened front surface 132.

In accordance with the invention, the ball contacting front member is fixed to the front of the back member 22. However, it will be appreciated that the front member 130 and the back member 22 may be formed as a single unit without departing from the spirit of the invention. It will also be appreciated that the hand conformed back surface 130 may have elongated depressions for fewer than all of the user's fingers. Alternatively, it is possible that a single elongated depression may be provided for two fingers without departing from the spirit of the invention.

It will be appreciated that various modifications and changes in the invention as described above can be made without departing from the invention in its broadest aspects. Consequently it is the objective of the following claims to cover all such modifications and variations as fall within the true scope of the invention.

What is claimed is:

1. A paddleball game hand paddle for being worn on the fingered hand of a user comprising:

a back member having a lower edge for positioning adjacent the wrist of a user and a hand conformed back surface comprising:

a contoured palm support region;

a plurality of elongated depressions extending from the palm support region, each for receiving a finger of the hand of the user at least one of the elongated depressions having a finger gripping ridge transverse thereto at a distal location relative to the palm support region for being gripped by the end of the finger positioned in that elongated depression;

a thumb manipulation region adjacent both the palm support region and the elongated depressions for receiving the thumb of the user and allowing side-to-side and upward manipulation thereof;

a ball contacting front member affixed to the back member at a location opposite the hand conformed back surface;

retention strap means attached to the back member for holding the hand paddle on the user's hand; and a ball receiving depression in the thumb manipulation region.

2. The hand paddle of claim 1 wherein there are four elongated depressions, one for each finger of the user's hand.

3. The hand paddle of claim 1 wherein the retention strap means comprises:

finger strap means attached to the hand conformed back surface of the back member and extending across at least one of the elongated depressions for retaining a user's finger in the elongated depression;

hand strap means attached to the hand conformed back surface of the back member and extending across the contoured palm support region for retaining the user's palm adjacent to the palm support region; and wrist strap means affixed to the back member for being wrapped around the user's wrist.

4. The hand paddle of claim 3 wherein the finger strap means comprises an elastic finger strap attached to the back member at a location on each side of each elongated depression.

5. The hand paddle of claim 4 wherein the hand strap means comprises a pair of elastic hand straps attached to crisscross the palm support region.

6. The hand paddle of claim 5 wherein the back member has a front surface opposite the back surface and the wrist strap means comprises:

a Y shaped strap defining a leg strap and two arm straps each arm strap having an end region, the leg strap affixed to the front surface of the back member and extending out from the lower edge for being adjacent the palm side of the user's wrist; and attachment means for removably coupling the end regions of the two arm straps to the hand strap means, the arm straps positioned for extending from the palm side of the user's wrist around opposite sides of the user's wrist, and crisscrossing over the top of the user's hand.

7. The hand paddle of claim 4 wherein the back member has a front surface opposite the back surface and the wrist strap means comprises:

a Y shaped strap defining a leg strap and two arm straps each arm strap having an end region, the leg strap affixed to the front surface of the back member and extending out from the lower edge for being adjacent the palm side of the user's wrist; and attachment means for removably coupling the end regions of the two arm straps to the hand strap means, the arm straps positioned for extending from the palm side of the user's wrist around opposite sides of the user's wrist, and crisscrossing over the top of the user's hand.

8. The hand paddle of claim 4 further comprising a thumb gripping surface between the thumb manipulation region and the elongated depressions to facilitate gripping of the back member by the user's thumb, the thumb gripping surface generally extending in the same direction as the elongated depressions and generally transverse to the finger gripping ridges.

9. The hand paddle of claim 3 wherein the hand strap means comprises a pair of elastic hand straps attached to crisscross the palm support region.

10. The hand paddle of claim 9 wherein the back member has a front surface opposite the back surface and the wrist strap means comprises:

a Y shaped strap defining a leg strap and two arm straps each arm strap having an end region, the leg strap affixed to the front surface of the back member and extending out from the lower edge for being adjacent the palm side of the user's wrist; and attachment means for removably coupling the end regions of the two arm straps to the hand strap means, the arm straps positioned for extending from the palm side of the user's wrist around opposite sides of the user's wrist, and crisscrossing over the top of the user's hand.

11. The hand paddle of claim 9 further comprising a thumb gripping surface between the thumb manipulation region and the elongated depressions to facilitate gripping of the back member by the user's thumb, the thumb gripping surface generally extending in the same direction as the elongated depressions and generally transverse to the finger gripping ridges.

12. The hand paddle of claim 3 wherein the back member has a front surface opposite the back surface and the wrist strap means comprises:

a Y shaped strap defining a leg strap and two arm straps each arm strap having an end region, the leg strap affixed to the front surface of the back member and extending out from the lower edge for being adjacent the palm side of the user's wrist; and attachment means for removably coupling the end regions of the two arm straps to the hand strap means, the arm straps positioned for extending from the palm side of the user's wrist around opposite sides of the user's wrist, and crisscrossing over the top of the user's hand.

13. The hand paddle of claim 12 wherein the attachment means comprises a first adherent strip affixed to the end region of one arm strap, a second adherent strip affixed to the end region of the other arm strap, a third adherent strip attached to the hand strap means adjacent the thumb manipulation region and a fourth adherent strip attached to the hand strap means adjacent the edge of the back member remote from and laterally opposite the thumb manipulation region, the first adherent strip being releasably coupleable to the third adherent strip and the second adherent strip being releasably coupleable to the fourth adherent strip.

14. The hand paddle of claim 13 further comprising a thumb gripping surface between the thumb manipulation region and the elongated depressions to facilitate gripping of the back member by the user's thumb, the thumb gripping surface generally extending in the same direction as the elongated depressions and generally transverse to the finger gripping ridges.

15. The hand paddle of claim 12 further comprising a thumb gripping surface between the thumb manipulation region and the elongated depressions to facilitate gripping of the back member by the user's thumb, the thumb gripping surface generally extending in the same direction as the elongated depressions and generally transverse to the finger gripping ridges.

16. The hand paddle of claim 3 further comprising a thumb gripping surface between the thumb manipulation region and the elongated depressions to facilitate gripping of the back member by the user's thumb, the thumb gripping surface generally extending in the same direction as the elongated depressions and generally transverse to the finger gripping ridges.

17. The hand paddle of claim 1 wherein the front member defines a continuous planar front surface having a roughened surface texture.

18. The hand paddle of claim 1 wherein the back member and the front member are generally oval in shape and are larger than the hand of the user.

19. The hand paddle of claim 1 wherein the back member is molded plastic and the hand conformed back surface is roughened to facilitate gripping by the user's hand.

20. The hand paddle of claim 1 further comprising a thumb gripping surface between the thumb manipulation region and the elongated depressions to facilitate gripping of the back member by the user's thumb, the thumb gripping surface generally extending in the same direction as the elongated depressions and generally transverse to the finger gripping ridges.

21. The hand paddle of claim 1 for use in hitting a spherical game ball having a contour wherein the ball receiving depression is spherically shaped and is sized for conforming to the contour of the game ball.

22. A paddle ball game hand paddle for being worn on the fingered hand of a user comprising:

a ball contacting front surface;

a contoured back surface for receiving the hand of the user comprising a contoured palm support region for supporting the palm of the user's hand;

a plurality of elongated finger receiving depressions extending radially outwardly from the palm support region, each elongated depression contoured and sized to receive a specific one of the user's fingers, and having a finger gripping ridge disposed transversely across the elongated depression at a distal location relative to the palm support surface for being gripped by the end of the finger positioned in that elongated depression; and a thumb manipulation region adjacent both the palm support surface and the elongated depressions, the thumb manipulation region having a thumb gripping surface extending along the region adjacent the elongated depressions and the palm support surface generally in the direction of the elongated depressions and generally transverse to the finger gripping ridges for being pressed against by the user's thumb to grip the hand paddle;

retention strap means for holding the user's hand against the contoured back surface of the hand paddle during use; and a ball receiving depression in the thumb manipulation region.

23. The hand paddle of claim 22 wherein the retention strap means comprises:

finger strap means attached to the hand conformed back surface of the back member and extending across at least one of the elongated depressions for retaining one of the user's fingers in the elongated depression;

hand strap means attached to the hand conformed back surface of the back member and extending across the contoured palm support region for retaining the user's palm, adjacent to the palm support region; and wrist strap means affixed to the back member for being wrapped around the user's wrist.

24. The hand paddle of claim 23 wherein the finger strap means comprises an elastic finger strap attached to the back member at a location on each side of each elongated depression.

25. The hand paddle of claim 23 wherein the hand strap means comprises a pair of elastic hand straps attached to crisscross the palm support region.

26. The hand paddle of claim 23 wherein the back member has a front surface opposite the back surface and the wrist strap means comprises:

a Y shaped strap defining a leg strap and two arm straps each arm strap having an end region, the leg strap affixed to the front surface of the back member and extending out from the lower edge for being adjacent the palm side of the user's wrist; and attachment means for removably coupling the end regions of the two arm straps to the hand strap means, the arm straps positioned for extending from the palm side of the user's wrist around opposite sides of the user's wrist, and crisscrossing over the top of the user's hand.

* * * * *